US005176532A

United States Patent [19]

Herzog et al.

[11] Patent Number: 5,176,532

[45] Date of Patent: Jan. 5, 1993

[54] THREADED RECEPTACLE METHOD AND DEVICE

[75] Inventors: Richard R. Herzog, Arlington Heights; Kurt H. Lundtedt, Long Grove, both of Ill.

[73] Assignee: Illinois Tool Works Inc., Glenview, Ill.

[21] Appl. No.: 720,232

[22] Filed: Jun. 25, 1991

[51] Int. Cl.[5] ..... H01R 4/50

[52] U.S. Cl. ..... 439/340; 439/558; 439/444; 313/318

[58] Field of Search ..... 313/51, 318; 439/338, 439/339, 340, 306, 356, 360, 444, 733, 741, 541, 558, 699

[56] References Cited

U.S. PATENT DOCUMENTS

| | | | |
|---|---|---|---|
| 701,680 | 6/1902 | Chase | 439/340 X |
| 2,982,939 | 5/1961 | Kirk | 439/558 |
| 3,084,304 | 4/1963 | Sloan | 439/339 X |
| 3,604,919 | 9/1971 | MacPherson | 439/558 X |
| 3,781,755 | 12/1973 | Pitacco | 439/669 X |
| 3,783,435 | 1/1974 | Fisher | 439/340 |
| 3,936,131 | 2/1976 | Durand | 439/558 |

FOREIGN PATENT DOCUMENTS

| | | | |
|---|---|---|---|
| 0813978 | 5/1959 | United Kingdom | 439/558 |
| 1323601 | 7/1973 | United Kingdom | 439/558 |

*Primary Examiner*—Larry I. Schwartz
*Assistant Examiner*—Khiem Nguyen
*Attorney, Agent, or Firm*—Schwartz & Weinrieb

[57] ABSTRACT

A molded receptacle including an interior wall surface and screw threads formed on the interior wall surface by a mold core. The threads have a predetermined thread profile including root radii substantially corresponding to a desired thread standard and crest radii which are smaller than the root radii. The crests of the threads are deformable after molding to enable the mold core forming the threads to be stripped from the receptacle in a direction substantially perpendicular to the major axis of the threads to provide crests which are deformed from their original molded shape yet dimensioned to fall within the desired thread standard. The receptacle is utilized as a threaded socket having one or more electrical contact members. The socket includes a housing which can be formed as stated above including an interior side wall having the threads, a first closed end, a second open end and a first aperture formed through a portion of the housing. A first substantially flat electrical contact member extends through the first aperture and includes a first portion extending outwardly away from an exterior surface of the socket and a second portion extending onto the interior of the socket. The first contact member is fixed to the socket by manipulation of the first contact member with respect to the socket and provides resilient engagement between the first portion of the first contact member and an article to be threadingly inserted within the socket.

20 Claims, 3 Drawing Sheets

THREADED RECEPTACLE METHOD AND DEVICE

BACKGROUND OF THE INVENTION

1. Field of the Invention

This invention relates generally to threaded receptacles, and more particularly to a threaded electrical socket for a light bulb and a method of making the socket which includes non-binding threads and electrical contacts which readily can be connected to the socket without any additional fasteners and maintain continuity between the electrical contacts and the light bulb during vibration or extreme tolerance conditions between the light bulb threads and the socket threads to eliminate intermittent contact therebetween.

2. Description of the Related Art

Light bulb sockets or fixtures typically are cylindrical in shape, closed at one end, open at an opposite end and threaded on their interior wall surfaces to accept the threads of the light bulb. Two electrical contacts are secured in the inside of such sockets so that one contact engages with the base or bottom of the light bulb inserted in the socket and the other contact engages the side wall of the base of the light bulb. The electrical contacts typically are connected to the socket by fasteners, such as screws, and the sockets usually are made in more than one piece to enable easy molding of the sockets and assist in assembling the contacts within the socket.

These existing light bulb sockets typically are made from a non-conductive material, such as plastic, and can be utilized in a variety of lighting situations including appliances such as refrigerators, stoves and similar articles. An example of such a socket is shown in U.S. Pat. No. 3,783,435 which is assigned to the assignee of the present application.

That patent discloses a molded plastic light bulb accommodating housing formed of two symmetrical halves having electrical terminal members projecting therethrough, one for contacting the light bulb base and the other for contacting the base periphery. The electrical terminals are placed in position within one of the two symmetrical halves which then are welded together. The exterior surface of the housing includes engagement members for mounting the socket to a panel, such as a panel which forms the inner lining for a refrigerator. The socket is designed so that when mounted in an aperture of a panel, the axis of the socket will be positioned at a predetermined angle with respect to the plane of the panel.

Due to the large number of parts, these light bulb sockets and contacts are difficult to assemble, especially when small contacts and corresponding fasteners or fastening methods are utilized. Additionally, it is difficult to position such contacts within the socket to maintain continuity between the electrical contacts and the light bulb.

These assembly and positioning problems are even more pronounced when a socket is molded in one-piece. Typically, to mold a one-piece socket, the mold core and corresponding machinery used to form the interior of the socket and the interior threads are of a complex, expensive design which usually include either a collapsible mold core or a mold core which is unscrewed from the socket as it is removed after molding. These complex mold cores are necessary to provide interior screw threads that substantially match a desired thread standard corresponding to the threads on the light bulb.

An easier and less expensive way to form a one-piece socket is with a simple non-collapsible mold core having exterior threads which form the desired threads on the socket interior. Such a mold core merely is pulled out or stripped from the socket after molding. As the mold core is pulled out, however, the crests of the threads on the interior of the socket become deformed as the crests on the threads of the mold core are passed thereover. Typically, this deformation leaves the interior socket threads with a thread profile that is outside the thread profile of the desired thread standard. As a result, when a light bulb or thread testing gauge later is threadingly inserted into the socket, the threads do not properly match and binding occurs between the socket and bulb or gauge threads.

It therefore is desirable to provide an electrical socket having threads and electrical contacts which readily can be connected to the socket without any additional fasteners and which maintain continuity between the contacts and the light bulb, especially during vibration or extreme tolerance conditions between the socket threads and the bulb threads, to eliminate intermittent contact therebetween.

It also would be desirable to provide a one-piece molded socket formed with a simple mold core which merely can be pulled out of the socket after molding and provides the socket threads with a thread profile which closely matches the desired standard for proper threaded bulb engagement while eliminating any thread binding.

SUMMARY OF THE INVENTION

The invention provides a molded receptacle including an interior wall surface and screw threads formed on the interior wall surface by a mold core. The threads have a predetermined thread profile including root radii substantially corresponding to a desired thread standard and crest radii which are smaller than the root radii. The crests of the threads are deformable after molding to enable the mold core forming the threads to be stripped from the receptacle in a direction substantially perpendicular to the major axis of the threads to provide crests which are deformed from their original molded shape yet dimensioned to fall within the desired thread standard.

The receptacle is utilized as a threaded socket having one or more electrical contact members. The socket includes a housing which can be formed as stated above including an interior side wall having the threads, a first closed end, a second open end and a first aperture formed through a portion of the housing. A first substantially flat electrical contact member extends through the first aperture and includes a first portion extending outwardly away from an exterior surface of the socket housing and a second portion extending onto the interior of the socket housing. The first contact member is fixed to the socket housing by manipulation of the first contact member with respect to the socket housing and provides resilient engagement between the second portion of the first contact member and an article to be threadingly inserted within the socket housing.

The socket housing also can include a second aperture which accepts a second substantially flat electrical contact member having first and second portions similar to the first electrical contact member as well as a resilient leg for retaining the second contact within the socket housing and biasing the second contact toward the second open end of the socket housing. Both the first and second contact members are inserted from the exterior of the socket housing either through the side wall or the first closed end of the socket housing and can include apertures to locate bending thereof and barbs to restrict the amount of insertion.

The socket housing can be connected to a panel, such as a panel of an appliance, and can be positioned with the central axis of the socket housing at a desired angle with respect to the plane of the panel.

DESCRIPTION OF THE PREFERRED EMBODIMENTS

Figure 1:
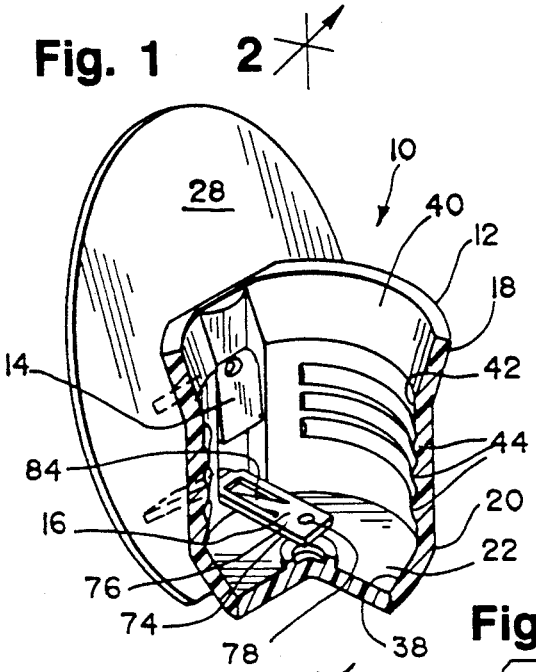
FIG. 1 is a front partial perspective view of an embodiment of the light socket device of the invention with a portion of the light socket housing broken away to illustrate the light socket interior and electrical contacts.
Figure 2:
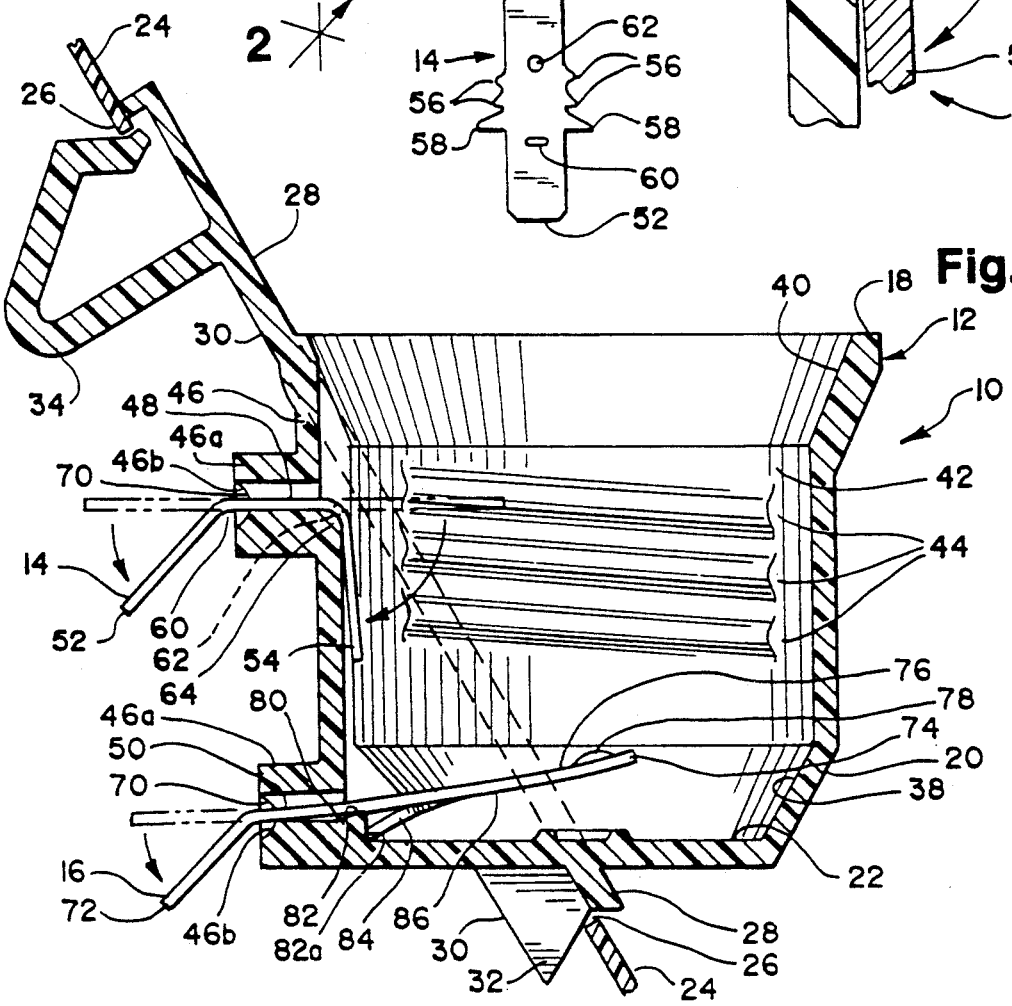
FIG. 2 is a longitudinal sectional view of the light socket device taken along the line 2—2 of FIG. 1 in the direction indicated generally, illustrating the light socket device connected to a panel and positioning of the two electrical contacts through the side wall of the light socket housing.

Referring to FIGS. 1 and 2, the light socket device of the invention is designated generally by the reference numeral 10. The light socket 10 preferably only includes three separate parts: a socket housing 12; a top electrical contact member 14 and a bottom electrical contact member 16.

As FIG. 2 illustrates, the socket housing 12 generally is cylindrical in shape having a first top open end 18 and a second bottom end 20 closed with a bottom wall 22. The socket housing 12 can be utilized in conjunction with a panel 24, such as a panel forming the wall of an appliance or the like. The panel 24 includes an aperture 26 through which a portion of the socket housing 12 is inserted.

The socket housing 12 is designed so that when it is inserted into the aperture 26 of the panel 24, the central axis of the socket housing 12 is positioned at a predetermined angle with respect to the plane of the panel 24. Preferably, the socket housing 12 is designed so that its central axis forms an angle of approximately thirty degrees with respect to the plane of the panel 24, but can vary.

To connect the socket housing 12 to the panel 24, the socket housing 12 preferably includes a flange 28 formed about its exterior and at a thirty degree angle with respect to the central axis of the socket housing 12 to overlie the aperture 26 of the panel 24 and provide the desired thirty degree angle with respect to the panel 24. To locate and secure the socket housing 12 to the panel 24, a back side 30 of the flange 28 includes a locating leg member 32 on one end of the flange 28 adapted to interlock with the margin of the aperture 26 and a resilient engagement prong member 34 on an opposite end of the flange 28. If desired, the back side 30 of the flange 28 can include one or more additional locator legs (not illustrated) to assist in alignment of the socket housing 12 within the aperture 26 of the panel 24.

Briefly, to install the socket housing 12 to the panel 24, the leg member 32 is inserted within the aperture 26 against the margin of the aperture 26 of the panel 24 and the socket housing 12 is rotated from right to left with respect to FIG. 2. Continued rotation enables the resilient engagement prong member 34 to flexibly seat within the aperture 26 against the panel 24 and retain the socket housing 12 therein as FIG. 2 illustrates. This particular design of the socket housing 12 enables installation from one side of the panel 24 without the need to access the back side of the panel 24 or provide any additional fasteners.

It is to be understood that the socket housing 12 can be utilized with or without a panel 24 and corresponding aperture 26. Additionally, the particular connection of the socket housing 12 to the panel 24 can vary without departing from the teachings of the present invention.

Figure 9:
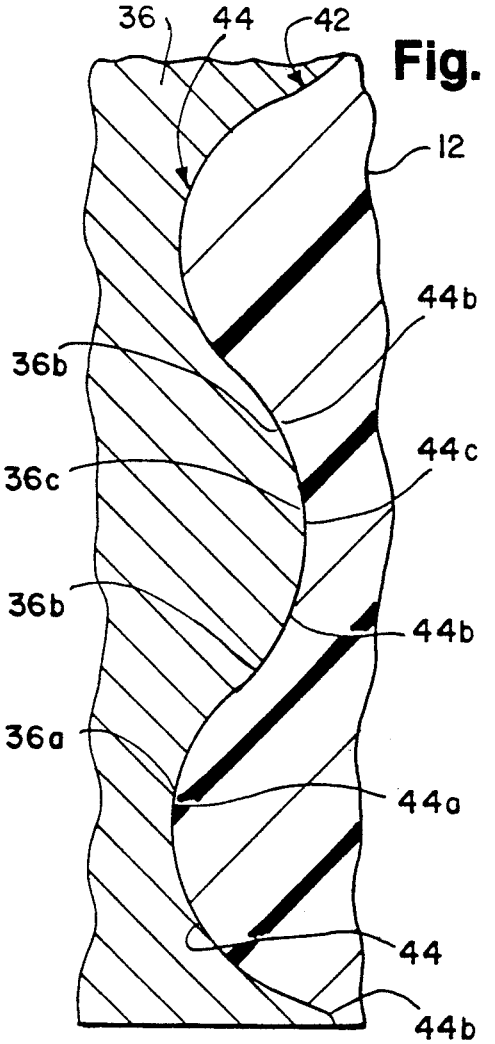
FIG. 9 is an enlarged cross-sectional view of a portion of the side wall of a light socket and the corresponding mold core utilized to form the internal threads on the light socket illustrating the thread profile of the invention.

The socket housing 12 preferably is a one-piece plastic housing formed by injection molding as will be described in detail below. To form the inside of the socket, a noncollapsible mold core 36, illustrated in FIG. 9, is utilized. To assist in removing the mold core 36, the second bottom end 20 of the socket housing 12 is tapered on an inside surface 38 and the first top open end 18 includes an outward flared surface 40. The flared surface 40 also assists in insertion and seating of a light bulb (not illustrated) within the interior of the socket housing 12.

To threadingly engage the light bulb within the socket housing 12, an interior wall surface 42 of the socket housing 12 includes threads 44 formed thereon. The threads 44 are specifically designed and dimensioned so that the mold core 36 can be utilized and readily pulled out of the socket housing 12 after molding without causing the threads 44 to bind when the light bulb or a thread testing gauge 35 later is threadingly inserted within the socket housing 12. The specific details of the threads 44 will be discussed below with regard to FIGS. 9–11.

As FIG. 2 illustrates, the socket housing 12 includes a side wall 46 having a first top aperture 48 and a second bottom aperture 50 formed therethrough. The apertures 48 and 50 preferably are slotted apertures and accept the flat top and bottom electrical contact members 14 and 16, respectively. To assist in insertion of the contact members 14 and 16, the side wall 46 is formed with sleeves 46*a* about the apertures 48 and 50 which include flared openings 46*b*.

Figure 3:
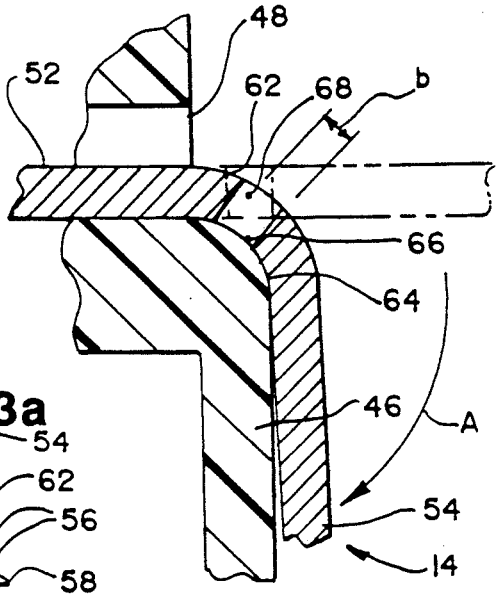
FIG. 3 is an enlarged view of a portion of the light socket of FIG. 2 illustrating bending of one of the electrical contacts with respect to the side wall of the light socket housing.
Figure 3A:
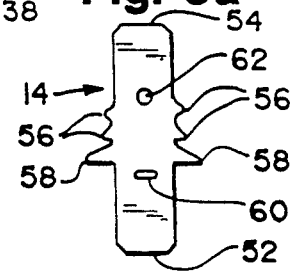
FIG. 3*a* is an enlarged front elevational view of the electrical contact of FIG. 3.

The top electrical contact member 14 is illustrated in detail in FIG. 3*a* and is utilized for engagement with a side surface of the light bulb base and provides the desired electrical contact between the contact member 14 and the light bulb base. Preferably, the contact member 14 is made from a conductive metal to provide the desired electrical conduction as well as a resilient spring force against the light bulb base, which typically is tapered. The material and shape of the contact member 14, as well as the contact member 16, can vary so long as the contacts 14 and 16 function a described herein.

To engage the light bulb base, the contact member 14, when in its final assembled position illustrated in FIGS. 1–3, extends a predetermined distance into the interior of the socket housing 12 and is bent to a predetermined position toward the bottom wall 22 of the socket housing 12 to form a desired angle with respect to the internal wall surface 42. This provides resilient engagement with the side surface of the light bulb base when threaded therein, which in turn assists in proper engagement of the light bulb base threads with the threads 44 and eliminates intermittent contact between the contact 14 and the light bulb base. This is particularly important during extreme temperature conditions and vibration of the appliance or similar article utilized with the light socket 10 and during extreme tolerance conditions between the threads 44 and the light bulb threads.

As FIG. 3*a* illustrates, the contact member 14 is a substantially flat, elongate member having a first outside end 52, which remains on the outside of the socket housing 12, and a second inside end 54, which remains on the inside of the socket housing 12, after assembly. To assist in engagement and alignment of the contact member 14 within the aperture 48 and resist removal of the contact member 14, each longitudinal side of the contact member 14 includes one or more barbs 56. To further assist in securing the contact member 14 within the aperture 48 and provide a stop against further insertion of the contact member 14, an enlarged barb 58 is formed on either longitudinal side of the contact member 14.

As FIG. 2 illustrates, preferably, both ends 52 and 54 of the contact member 14 are bent downward after insertion in the aperture 48 toward the bottom wall 22 of the socket housing 12. In order to assist in precisely locating the bend for each end 52 and 54, the contact member 14 includes first and second apertures 60 and 62 for bending the first end 52 and the second end 54, respectively, of the contact member 14. The apertures 60 and 62 enable easy bending only at these points and prevent deforming the remaining flat portions of the contact member 14 from their flat or linear shapes.

Preferably, for further ease of bending, the aperture 60 is oval in shape. The particular size and shape of the aperture 60, as well as the aperture 62, however, can vary.

The first outside end 52 of the contact member 14 is positioned for connection to an electrical lead (not illustrated.) The lead can be connected to the first outside end 52 in a variety of ways and is routed to a power source within the appliance or similar article to which the socket housing 12 is to be connected.

The aperture 62 preferably is circular in shape and is positioned with respect to the enlarged barbs 58 and the side wall 46 so that when the inside end 54 of the contact member 14 is bent, it engages and grips the interior wall surface 42 of the side wall 46 of the socket housing 12 and pulls the contact member 14 toward the interior of the socket housing 12. More specifically, as FIG. 3*a* illustrates, an inside bottom edge or corner 64 of the aperture 48 is slightly rounded to form an arc having a midpoint substantially located at point 66. The contact member 14 will bend about a midpoint 68 of the aperture 62. The midpoint 68 typically is aligned so that when the inside end 54 is bent in the direction of arrow "A" from its initial insertion position, illustrated in dotted outline, to its final position proximate the side wall 46, the midpoint 68 of the aperture 62 aligns with the midpoint 66 of the inside bottom edge or corner 64 of the aperture 48. The alignment of the midpoints 68 and 66 is not illustrated.

As FIG. 3 illustrates, however, the midpoint 68 of the aperture 62 is positioned so that it is slightly biased or offset toward the outside end 52 of the contact member 14 a slight distance "b". Thus, due to the relationship between the barbs 58, an outside point 70 (FIG. 2) which abuts the barbs 58 and the inside bottom edge 64 of the aperture 48, the midpoint 68 of the aperture 62 does not align with the midpoint 66 during bending. With this design, the bending exerts an inward gripping and pulling force on the contact member 14 to firmly seat the contact member 14 within the aperture 48 and restrict removal.

The bottom contact member 16 is utilized for electrical contact with the bottom of the light bulb base and, as FIG. 2 illustrates, likewise is a substantially flat, elongate member having a first outside end 72, which remains on the outside of the socket housing 12, and a second inside end 74, which remains on the inside of the socket housing 12. To assist in engagement of the contact member 16 within the aperture 50, the contact member 16 can include one or more barbs (not illustrated) similar to the barbs 56 and 58 of the contact member 14.

Preferably, only the outside end 72 of the contact member 16 is bent downward. Accordingly, to locate the bending point and prevent distortion of the flat surfaces of the contact member 16, an aperture (not illustrated), similar to the apertures 60 and 62 of the contact member 14, can be formed in the contact member 16. As with the contact member 14, the outside end 72 of the contact member 16 is designed for connection to an electrical lead (not illustrated) for completing the electrical circuit through the light bulb.

As FIGS. 1 and 2 illustrate, to assist in engagement with the bottom surface of the light bulb base, a top surface 76 of the inside end 74 of the contact member 16 includes a raised dimple 78. Additionally, to further assist in contact with the bottom surface of the light bulb base to reduce intermittent electrical contact and take up any slack between the threads 44 of the socket housing 12 and the threads of the light bulb base, the inside end 74 of the contact member 16 can be angled upward away from the bottom wall 22 of the socket housing 12.

To provide the upward bending of the contact member 16, an inside bottom edge 80 of the bottom aperture 50 includes an upward sloped ramp portion 82. Thus, upon insertion of the contact member 16 within the aperture 50, the inside end 74 of the contact member 16 is deflected upward as illustrated to a desired angle, which can vary.

To assist in maintaining the inside end 74 of the contact member 16 in the desired upward position, for providing a resilient spring force to the contact member 16 and for restricting removal of the contact member 16 from the socket housing 12, a resilient leg 84 is struck substantially along the center of a bottom side 86 of the contact member 16 and extends downward toward the bottom wall 22 of the socket housing 12 when inserted in the socket housing 12. Thus, upon insertion of the contact member 16 within the aperture 50 a predetermined distance defined by the positioning of the enlarged barb (not illustrated) and corresponding outside insertion point 70 of the aperture 50, the resilient leg 84 snaps over the end of the ramp 82 to engage the ramp end 82*a* and bottom wall 22 and restricts removal of the contact member 16 while providing the desired spring force to the contact member 16.

To assemble the light socket 10 illustrated in FIGS. 1–3*a*, the socket housing 12 is provided with the threads 44, apertures 48 and 50 and ramp 82. Next, the contact members 14 and 16 are inserted, either separately or simultaneously, into the respective apertures 48 and 50 until the enlarged barbs 58 engage the outside points 70 of the apertures 48 and 50. At this point, the resilient leg 84 of the contact member 16 seats behind the ramp end 82*a* as illustrated in FIG. 2. Next a bending tool (not illustrated) is inserted within the socket housing 12, engages the inside end 54 of the contact member 14 and bends the contact member 14 about the biased aperture 62 to grip the inside curved edge 64 of the aperture 48 and connect and pull the contact member 14 inward.

The socket housing 12 now is ready for connection to the electrical leads and, if desired, installation in a panel 24 as described above. It is to be noted that assembly of the socket housing 12 and the contact members 14 and 11 can be accomplished manually or can be fully automated. Additionally, the electrical leads can be connected to the contact members 14 and 16 before or after installation with the panel.

FIGS. 4–8 illustrate an alternate embodiment of the light socket 110 where common elements are referred to by the same reference numerals. In this embodiment, the socket housing 112 includes two contact members 114 and 116 which extend through the bottom wall 122 so that the socket housing 112 can be positioned approximately perpendicular with respect to the panel 24.

Figure 5:
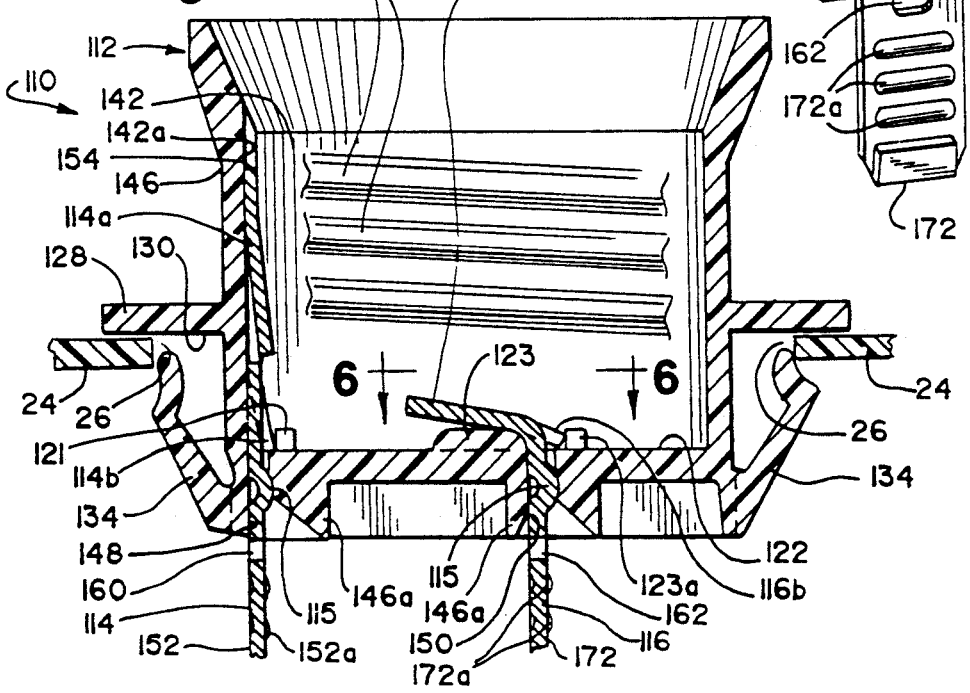
FIG. 5 is a longitudinal sectional view of the light socket device taken along the line 5—5 of FIG. 4 in the direction indicated generally, illustrating the light socket device connected to a panel and positioning of the two electrical contacts through the bottom of the light socket housing.

As FIG. 5 illustrates, to connect the socket housing 112 to an aperture 26 in a panel 24, the socket housing 112 includes a flange 128 positioned about the outside periphery of the side wall 146 of the socket housing 112 as well as two resilient engagement prong members 134, one each on opposite sides of the socket housing 112. Thus, similar to the embodiment of FIGS. 1–3*a*, the socket housing 112 is inserted within the aperture 26 of the panel 24 and the resilient engagement prong members 134 engage the margins of the aperture 26. If desired, additional locator arms (not illustrated) can be positioned about the bottom side 130 of the flange 128 to assist in alignment of the socket housing 112 with the aperture 26 of the panel 24.

in this embodiment, the bottom 122 of the socket housing 112 includes slotted apertures 148 and 150 for the flat contact members 114 and 116, respectively. The contact member 114 extends through the aperture 148 and along the interior wall surface 142 of the socket housing 112. To assist in positioning of the contact member 114, the interior wall surface 142 can include a slot 142*a* for receiving the contact member 114 therein.

It is to be noted that the positioning of the apertures 48/148 and 50/150 within the respective side wall 46/146 and bottom 22/122 of the socket housing 12/112 can be interchanged so long as they function as described. For example, the socket housing 12/112 can be formed with the aperture 48 in the side wall 46 for the contact member 14 and the aperture 150 in the bottom 122 for the contact member 116 (not illustrated).

The contact member 114 is a substantially flat, elongate member having a first outside end 152, which remains on the outside of the socket housing 112, and a second inside end 154, which remains on the inside of the socket housing 112. The inside end 154 of the contact member 114 is designed for electrical contact with the side surface of the light bulb base. To assist in such electrical contact and for proper thread engagement of the threads 44 of the socket housing 112 and the threads on the light bulb base, the contact member 114 can include a first resilient leg member 114*a* which is struck from the surface of, or otherwise connected to, the contact member 114 so that it extends into the interior of the socket housing 112 when assembled.

To restrict removal of the contact member 114 from the aperture 148, the contact member 114 also includes a pair of second resilient leg members 114*b* which likewise are struck from the surface of the contact member 114 on opposite longitudinal sides of the contact member 114 so that they extend into the interior of the socket housing 112 when assembled. The second resilient leg members 114*b* function similar to the resilient leg 84 of the contact member 16 of the embodiment of FIGS. 1–3*a*. Thus, upon insertion, the second resilient leg members 114*b* extend into the socket housing 112 after they clear the aperture 148 and engage with the bottom wall 122 to restrict removal of the contact member 114.

To restrict further inward extension of the second resilient leg members 114*b*, the bottom surface 122 is formed with a pair of upstanding stops 121, one each for engagement with a respective second resilient leg member 114*b*. The stops 121 prevent inward displacement of the second resilient leg members 114*b* along the bottom surface 122 which may occur if an attempt is made to pull the contact member 114 out of the aperture 148.

The contact member 116 likewise is a substantially flat, elongate member having a first outside end 172 and a second inside end 174. As FIG. 8 illustrates, the contact member 116 includes barbs 156 and 158 as well as a bending aperture 162 for locating a bend on the outside end 172, if desired.

Figure 6:
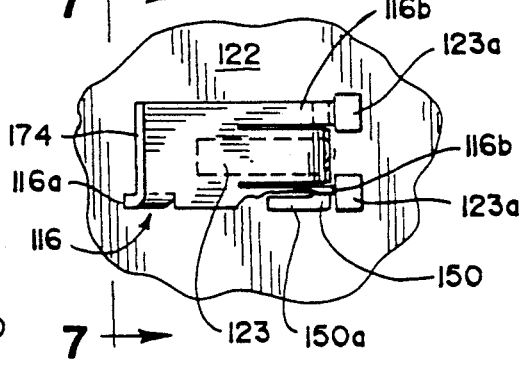
FIG. 6 is an enlarged elevational view of the interior bottom surface of the light socket device of FIG. 4 illustrating the bottom electrical contact in detail.
Figure 7:
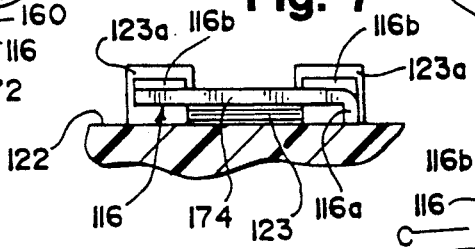
FIG. 7 is an enlarged sectional view of the bottom electrical contact within the light socket taken along the line 7—7 of FIG. 6 in the direction indicated generally.

To ensure proper insertion of the contact member 116 in the aperture 150, the second inside end 174 is keyed with a leg 116*a* extending substantially perpendicular to the plane of the contact member 116. Thus, as FIG. 6 illustrates, the aperture 150 includes a complementary keyway 150*a* through which the leg 116*a* is inserted. If desired, the contact member 114, as well as the contact members 14 and 16 of the embodiment of FIGS. 1-3*a*, can be keyed in a similar manner.

To retain the contact member 116 within the socket housing 112 and provide the desired upward spring force to the contact member 116 against a light bulb base, opposite longitudinal sides of the contact member 116 are struck to form a pair of resilient leg members 116*b*, one each per side. The leg members 116*b* function similar to the second resilient leg members 114*b* of contact member 114.

Figure 4:
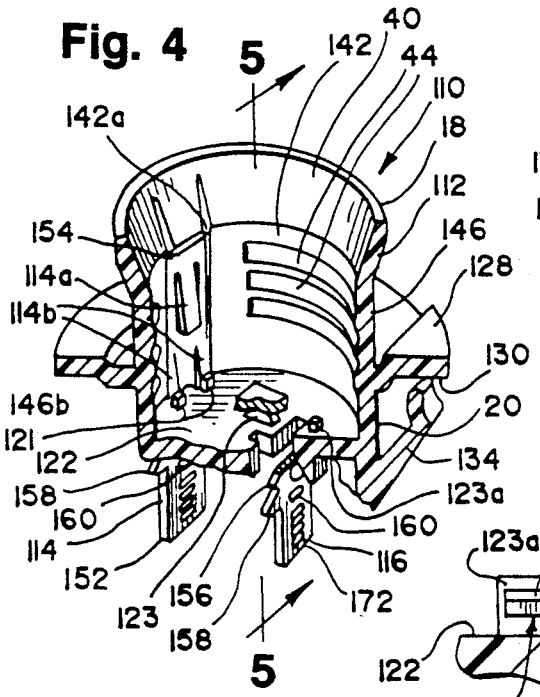
FIG. 4 is a partial perspective view of another embodiment of the light socket device of the invention with a portion of the light socket housing broken away to illustrate the light socket interior and electrical contacts.
Figure 8:
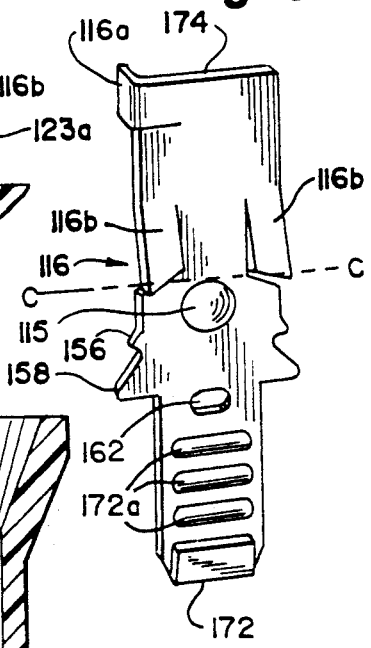
FIG. 8 is an enlarged perspective view of the bottom electrical contact of FIG. 7.

After insertion of the contact member 116, however, the contact member 116 is bent substantially about the line c—c of FIG. 8 proximate the position where the distal ends of the resilient leg members 116*b* were struck from the contact member 116 leaving a reduced lateral portion of the contact member 116. As FIGS. 4-6 illustrate, the contact member 116 is bent about a raised ramp portion 123 formed on the bottom side 122 of the socket housing 112 on the side of the aperture 150 facing the aperture 148.

As the contact member 116 is bent, the resilient leg members 116*b* engage stops 123*a* formed on the bottom 122 of the socket housing 112 along the aperture 150 on the side of the aperture 150 opposite the ramp portion 123. Accordingly, the cooperation between the resilient leg members 116*b*, stops 123*a* and bottom 122 restricts removal of the contact member 116. This structure also provides an upward spring force to the contact member 116 to assist in engagement with the bottom of the light bulb base.

As FIG. 5 illustrates, in order to provide a tighter fit within the apertures 148 and 150, the contact members 114 and 116 include a raised dimple 115. As FIG. 8 illustrates with regard to contact member 116, the dimple 115 is formed substantially in the center of the contact member 116 between the distal ends of the resilient leg members 116*b* and the barbs 156. Thus, when positioned within the apertures 148 and 150, the dimples 115 engage the margins of the apertures 148 and 150 to provide the desired tight fit. It is to be noted that the dimples 115 slightly compress the margins of the apertures 148 and 150.

To assist a machine or a user in gripping the contact members 114 and 116 during insertion, the first outside ends 152 and 172 can be formed with one or more engagement ribs 152*a* and 172*a*. If desired, the contact members 14 and 16 of the embodiment of FIGS. 1-3*a* can include engagement ribs similar to ribs 152*a* and 172*a* and dimples similar to dimples 115.

To assemble the light socket 110, the socket housing 112 is provided with the threads 44, apertures 148 and 150 as well as the stops 121 and 123*a* and the ramp 123. Next, the contact members 114 and 116 are inserted, either separately or simultaneously, within the corresponding apertures 148 and 150 until the barbs 158 engage the outside points 70 of the apertures 148 and 150. At this point, the resilient leg members 114*b* engage the bottom wall 122 and stops 121 to restrict removal of the contact member 114. Next, a bending tool (not illustrated) is inserted within the socket housing 112, engages the inside end 174 of the contact member 116 and bends the contact member 116 about the line c—c to the final assembly position with the resilient leg members 116*b* engaged with the stops 123*a* to restrict removal of the contact member 116. If desired, the first outside ends 152 and 172 of the contact members 114 and 116 can be bent about apertures 160 and 162 and the socket housing 112 connected to a panel 24 as described in the previous embodiment.

The molding of the socket housing 112 now will be explained in detail with reference to FIGS. 9-11. FIG. 9 illustrates a portion of the threads 44 formed on the interior wall surface 42 of the socket housing 12 engaged with a portion of the mold core 36 utilized to form the interior threads 44 of the socket housing 12 or 112. The threads 44 are formed with crests 44*a*, roots 44*b* and slightly flat portions 44*c* between the roots 44*b* to a specific profile. The flat portions 44*c* are utilized to maintain proper spacing between crests 44*a* and the length of the flat portions 44*c* may vary, or the flat portions 44*c* may not be necessary. The crests 44*a*, roots 44*b* and flat portions 44*c* are formed by corresponding roots 36*a*, crests 36*b* and slightly flat portions 36*c* between the crests 36*b* of the mold core 36.

As discussed above, the easiest and least expensive way to mold the socket housing 12 in one-piece is to provide a non-collapsible mold core 36. After molding, the mold core 36 merely is pulled out or stripped from the socket housing 12, typically while the socket housing 12 still is slightly soft and retained in the remainder of the mold (not illustrated) forming the outside surfaces of the socket housing 12.

Figure 10:
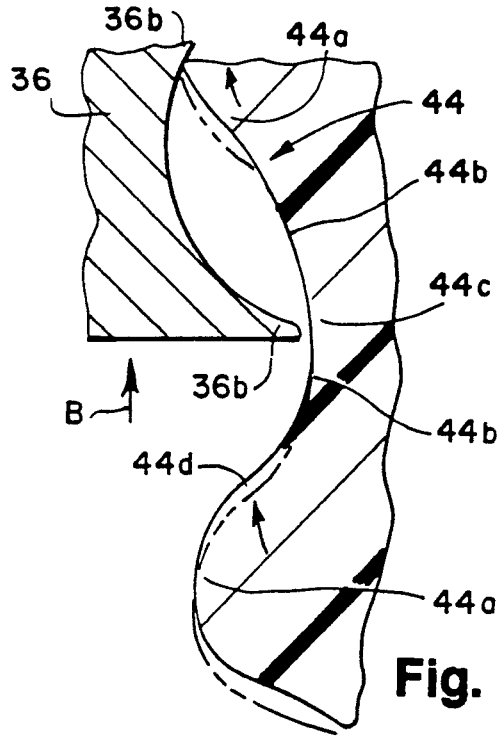
FIG. 10 is an enlarged cross-sectional view, similar to FIG. 9, illustrating the mold core being pulled out of the light socket after molding and deformation of the crests on the light socket threads.

As FIG. 10 illustrates, however, as the mold core 36 is pulled out of the socket housing 12 in the direction of arrow "B", the crests 36*b* of the mold core 36 must pass over the crests 44*a* of the threads 44. Thus, the crests 44*a* of the threads 44 become slightly deformed from their initial shape which is indicated in dotted outline in FIGS. 10 and 11. This deformation provides a build up of material at 44*d* on the outside edge of each thread 44 facing the top open end 18 of the socket housing 12. Additionally, the crest 44*a* which is closest to the top open end 18 of the socket housing 12 typically is deformed the most since several mold core crests 36*b* pass thereover as the mold core 36 is pulled out.

The material 44*d* typically provides threads 44 which fall outside the thread profile of the desired standard and cause binding cf a test gauge 45, which simulates the thread size of the light bulb base to be inserted later. Thus, a non-collapsible mold core 36 typically is not used, especially when close thread tolerances must be maintained.

Figure 11:
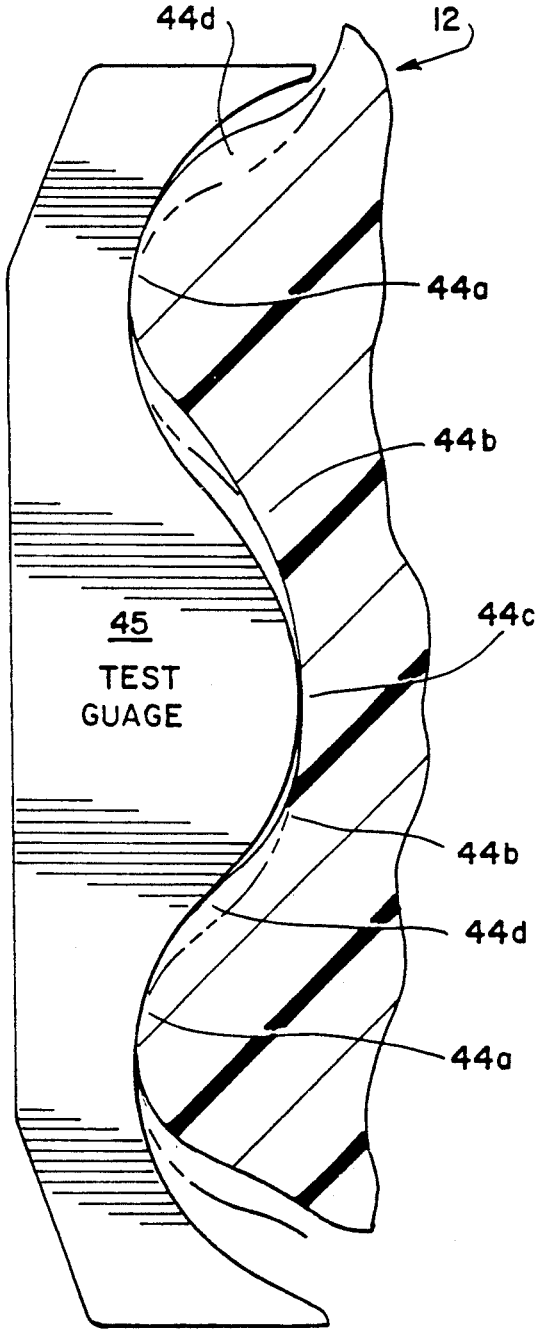
FIG. 11 is an enlarged cross-sectional view of a portion of the side wall of the light socket and a thread test gauge illustrating the deformed thread profile of the invention within the thread profile of the test gauge.

The threads 44 of FIGS. 9-11, however, are dimensioned to eliminate any binding. Specifically, as FIG. 9 illustrates, the crests 44*a* are formed with a radius which is somewhat less than the radius of the roots 44*b*. The radius of the roots 44*b* substantially are equal to the desired thread standard and preferably are slightly greater than the desired thread standard.

Accordingly, as FIG. 11 illustrates, when the test gauge 45, having the desired thread standard with the same crest and root radii, is threadingly engaged with the socket housing 12, the deformed crests 44*a* and the excess material 44*d* still fall within the desired thread profile represented by the test gauge 45. This eliminates any binding between the threads 44 and the threads on the test gauge 45 while still providing close thread engagement without any excessive play. The different radii between the crests 44*a* and roots 44*b* effectively provide a space within the thread profile of the test gauge 45 which accommodates the excess material 44*d*.

For example, if the desired thread standard is to be 0.046 inches (1.17 mm), it has been found that the radius of the roots 44*b* should be 0.047 inches (1.19 mm), +/−0.004 inches (0.10 mm), while the radius of the crests 44*a* should be 0.030 inches (0.76 mm), +/−0.004 inches (0.10 mm). As another example, if the desired thread standard is to be 0.030 inches (0.76 mm), it has been found that the radius of the roots 44*b* should be 0.031 inches (0.79 mm), +--0.004 inches (0.10 mm), and that the radius of the crests 44*a* should be 0.025 inches (0.63 mm), +/−0.004 inches (0.10 mm).

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A threaded socket device and associated electrical contact members, comprising:

an insulative housing formed as a threaded socket, said housing having an annular side wall and including threads formed upon an interior surface of said annular side wall, a first closed end, a second open end, and a first aperture formed through a portion of said housing having an exterior surface and an interior surface; and a first substantially flat electrical contact member extending through said first aperture, said first electrical contact member including a first portion extending outwardly away from said exterior surface of said housing portion and bent toward said exterior surface of said housing portion and about a first exterior corner portion defined upon said exterior surface of said housing portion and within the vicinity of said first aperture, and a second portion extending into the interior of said housing and bent toward said interior surface of said housing portion and about a second interior corner portion defined upon said interior surface of said housing portion and within the vicinity of said first aperture, said bent portions of said first electrical contact member fixing said first electrical contract member within said housing and providing resilient engagement between said second portion of said first electrical contact member and an article to be threadingly inserted within said housing so as to provide good electrical contact between said first electrical contact member and said article to be threadingly inserted within said housing.

2. The device as defined in claim 1, wherein:

said first aperture is formed within said side wall of said housing proximate said second open end of said housing and said device further includes a second aperture formed within said side wall proximate said first closed end of said housing and a second substantially flat electrical contact member extending through said second aperture, said second electrical contact member including a first portion extending outwardly away from the exterior surface of said housing and a second portion extending into the interior of said housing and means for restricting removal of said second electrical contact member from said housing.

3. The device as defined in claim 2, wherein:

said first electrical contact member includes means for restricting insertion of said first electrical contact member a desired amount into said housing, and an aperture defined within said first electrical contact member, said aperture of said first electrical contact member being positioned along said first electrical contact member so as to facilitate bending of said second portion substantially along the centerline of said aperture and at a desired position with respect to said housing and said insertion restricting means so as to provide said fixing of said first electrical contact member with respect to the housing upon said bending thereof.

4. The device as defined in claim 3, wherein:

said means for restricting insertion of said first electrical contact member includes a barb member extending therefrom which abuts a portion of said housing proximate said first aperture of said housing and upon insertion of said first electrical contact member into said housing so as to limit the amount of insertion of said first electrical contact member into said housing.

5. The device as defined in claim 2 wherein said means for restricting removal of said second electrical contact member includes a resilient leg formed on said second electrical contact member which is biased away from said second electrical contact member and, after full insertion, engages a portion of said housing to restrict removal of said second electrical contact member from said housing.

6. The device as defined in claim 1 including means for connecting said device to a planar surface at a predetermined angle with respect to said planar surface.

7. The device as defined in claim 1, wherein:

said first aperture of said housing is provided within said first closed end of said housing, and said device further includes a second aperture provided within said first closed end of said housing, and a second substantially flat electrical contact member extending through said second aperture of said housing, said second electrical contact member including a first portion extending outwardly away from the exterior surface of said housing and a second portion extending into the interior of said housing, and means for restricting removal of said second electrical contact member from said housing.

8. The device as defined in claim 7, wherein:

said first electrical contact member includes means for restricting insertion of said first electrical contact member a desired amount into said housing, at least one resilient leg formed upon said first electrical contact member at a predetermined position thereof, and means for facilitating bending of said first electrical contact member at a predetermined position thereof, said means for restricting insertion, said resilient leg, and said means for facilitating bending cooperating with said housing for providing said fixing of said first electrical contact member with respect to said housing upon bending of said first electrical contact member.

9. The device as defined in claim 8, wherein:

said means for restricting insertion of said first electrical contact member includes a barb member extending therefrom which abuts a portion of said housing proximate said first aperture of said housing and upon insertion of said first electrical contact member into said housing so as to limit the amount of insertion of said first electrical contact member into said housing.

10. The device as defined in claim 8, wherein:

an inside surface of said first closed end of said housing includes at least one upwardly extending stop member proximate said first aperture, said stop member being positioned for engagement with a distal end of said resilient leg of said first electrical contact member during and after bending of said first electrical contact member so as to restrict removal of said first electrical contact member from said housing.

11. The device as defined in claim 7 wherein said means for restricting removal of said second electrical contact member includes at least one resilient leg formed on said second electrical contact member which is biased away from said second electrical contact member and, after full insertion, engages an inside surface of said first closed end of said housing so as to restrict removal of said second electrical contact member from said housing.

12. The device as defined in claim 11, wherein:

said inside surface of said first closed end of said housing includes at least one upwardly extending stop member proximate said second aperture, said stop member being positioned for engagement with a distal end of said resilient leg of said second electrical contact member after full insertion of said second electrical contact member within said housing so as to restrict bending of said resilient leg and further restrict removal of said second electrical contact member from said housing.

13. The device as defined in claim 11 wherein said second aperture and said second electrical contact member are positioned proximate a portion of said annular side wall of said housing and said second electrical contact member further includes a resilient arm formed thereon and extending into the interior of said housing and biased away from the side wall of said housing for resilient engagement and electrical contact with said article to be inserted within said housing.

14. A threaded socket device and associated electrical contact member, comprising:

an insulative housing formed as a threaded socket, said housing comprising an annular side wall including threads formed upon an interior surface thereof, a first closed end, a second open end through which an article to be threadingly disposed within said socket is inserted and removal, and at least one through aperture formed within a portion of said housing having an exterior surface; and at least one substantially flat electrical contact member extending through said at least one through aperture of said housing, said at least one electrical contact member including a first portion extending outwardly away from said exterior surface of said housing portion, and a second portion extending into the interior of said housing, at least one of said first and second portions of said electrical contact member being bent at a predetermined portion thereof with respect to said housing after being disposed within said aperture of said housing so as to fix said electrical contact member within said housing, said electrical contact member further including means for engaging said portion of said housing proximate said aperture of said portion of said housing so as to limit the amount of insertion of said electrical contact member into said housing to a predetermined degree in the direction of insertion of said electrical contact member into said housing so as to accurately position said portion of said electrical contact member to be bent with respect to said housing.

15. A device as set forth in claim 14, wherein:

said means for engaging said portion of said housing so as to limit said amount of insertion of said electrical contact member into said housing comprises laterally extending barbs extending laterally outwardly from opposite longitudinal sides of said electrical contact member.

16. A threaded socket device and associated electrical contact members, comprising:

an insulative housing formed as a threaded socket, said housing comprising an annular side wall including threads formed upon an interior surface thereof, a first closed end, a second open end through which an article to be threadedly engaged within said socket is inserted and removed, and at least one through aperture formed within a portion of said housing having an exterior surface; and at least one substantially flat electrical contact member extending through said at least one through aperture of said housing, said at least one electrical contact member including a first portion extending outwardly away from said exterior surface of said housing portion, and a second portion extending into the interior of said housing, at least one of said first and second portions of said electrical contact member being bent at a predetermined portion thereof with respect to said housing after being disposed within said aperture of said housing so as to fix said electrical contact member within said housing, said at least one of said first and second portions of said electrical contact member which is to be bent with respect to said housing including aperture means formed within said predetermined portion thereof so as to facilitate bending of said at least one of said first and second portions of said electrical contact member precisely at said predetermined portion thereof.

17. A threaded socket device and associated electrical contact members, comprising:

an insulative housing formed as a threaded socket, said housing comprising an annular side wall including threads formed upon an interior surface thereof, a first closed end, a second open end through which an article to be threadedly engaged within said socket is inserted and removed, and at least one through aperture formed within a portion of said housing having an exterior surface and an interior surface;

at least one substantially flat electrical contact member extending through said at least one through aperture of said housing, said at least one electrical contact member including a first portion extending outwardly away from said exterior surface of said housing portion, and a second portion, having a free end portion, extending into the interior of said housing in a cantilevered manner; and ramp means formed upon said interior surface of said housing portion at a position within the vicinity of said at least one through aperture and extending away from said interior surface of said housing portion so as to project inwardly into said interior of said housing for engaging said at least one substantially flat electrical contact member when said at least one substantially flat electrical contact member is disposed within said at least one through aperture so as to bias said second portion, and said free end portion thereof, of said at least one electrical contact member toward said article threadedly engaged within said socket and thereby establish good mechanical engagement and electrical contact with said article threadedly engaged within said socket.

18. A threaded socket device and associated electrical contact members as set forth in claim 17, further comprising:

at least one resilient leg formed upon said second portion of said at least one substantially flat electrical contact member so as to be biased away from said second portion of said at least one substantially flat electrical contact member so as to engage said interior surface of said housing portion in order to restrict removal of said at least one substantially flat electrical contact member from said housing after full insertion of said at least one substantially flat electrical contact member within said housing; and stop means formed upon said interior surface of said housing portion at a position within the vicinity of said at least one through aperture and extending away from said interior surface of said housing portion so as to project inwardly into said interior of said housing for engaging a distal end portion of said resilient leg of said second portion of said at least one substantially flat electrical contact member so as to laterally restrict bending of said resilient leg of said second portion of said at least one substantially flat electrical contact member and thereby further restrict removal of said at least one substantially flat electrical contact member from said housing should a force be impressed upon said at least one substantially flat electrical contact member in a direction opposite to the direction of insertion of said at least one substantially flat electrical contact member into said housing.

19. A device as set forth in claim 18, wherein:

said stop means is formed upon said closed end of said socket.

20. A threaded socket device and associated electrical contact members, as set forth in claim 18, wherein:

said second portion of said electrical contact member includes a bent portion such that said second portion of said electrical contact member is disposed toward said interior surface of said housing portion so as to cooperate with said interior surface of said housing portion in order to fixedly retain said electrical contact member within said housing.

* * * * *

UNITED STATES PATENT AND TRADEMARK OFFICE

CERTIFICATE OF CORRECTION

PATENT NO. : 5,176,532

DATED : January 5, 1993

INVENTOR(S) : Herzog, et al

It is certified that error appears in the above-identified patent and that said Letters Patent is hereby corrected as shown below:

On the title page, Item [75] Inventors: "Kurt H. Lundtedt" should read --Kurt H. Lundstedt--.

Signed and Sealed this

Twenty-third Day of November, 1993

*Attest:*

Bruce Lehman

BRUCE LEHMAN

*Attesting Officer*

*Commissioner of Patents and Trademarks*